US007857301B2

(12) United States Patent
Samoto

(10) Patent No.: US 7,857,301 B2
(45) Date of Patent: Dec. 28, 2010

(54) SHEET FEED DEVICES AND IMAGE RECORDING APPARATUSES COMPRISING SUCH SHEET FEED DEVICES

(75) Inventor: Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 123 days.

(21) Appl. No.: 12/413,508

(22) Filed: Mar. 27, 2009

(65) Prior Publication Data

US 2009/0243186 A1 Oct. 1, 2009

(30) Foreign Application Priority Data

Mar. 31, 2008 (JP) ..... 2008-094339

(51) Int. Cl.
*B65H 3/44* (2006.01)

(52) U.S. Cl. ..... 271/9.01; 271/9.02; 271/9.05

(58) Field of Classification Search ..... 271/9.01, 271/9.02, 9.05, 114
See application file for complete search history.

(56) References Cited

U.S. PATENT DOCUMENTS

| | | | | |
|---|---|---|---|---|
| 3,920,238 | A * | 11/1975 | Kitajima et al. | 271/9.05 |
| 4,577,849 | A * | 3/1986 | Watanabe | 271/9.02 |
| 4,722,518 | A * | 2/1988 | Watanabe | 271/9.05 |
| 4,770,555 | A * | 9/1988 | Deschamps et al. | 400/624 |
| 7,059,596 | B2 | 6/2006 | Iwase | |
| 2005/0194732 | A1 | 9/2005 | Asada | |
| 2005/0194733 | A1 | 9/2005 | Asada | |
| 2007/0048058 | A1 | 3/2007 | Koga et al. | |
| 2007/0076036 | A1 | 4/2007 | Koga et al. | |

FOREIGN PATENT DOCUMENTS

| | | | |
|---|---|---|---|
| JP | H03-272937 | A | 12/1991 |
| JP | 2634005 | B2 | 5/1993 |
| JP | H07-165353 | A | 6/1995 |
| JP | 2001-130766 | A | 5/2001 |
| JP | 2001-158538 | A | 6/2001 |
| JP | 2002-060068 | A | 2/2002 |
| JP | 3648165 | B2 | 9/2002 |
| JP | 2003-321133 | A | 11/2003 |
| JP | 2005-247521 | A | 9/2005 |
| JP | 2005-247539 | A | 9/2005 |

OTHER PUBLICATIONS

Japan Patent Office, Notice of Reasons for Rejection for Japanese Patent Application No. 2008-094339 (counterpart to abouve-captioned patent application), mailed Jun. 8, 2010.

* cited by examiner

*Primary Examiner*—David H Bollinger
(74) *Attorney, Agent, or Firm*—Baker Botts L.L.P.

(57) ABSTRACT

A sheet feed device includes a motor that rotates in a first and second direction, a first transmitting mechanism having an upstream and a downstream portion, that transmits a rotational force in a first transmitting direction, a second transmitting mechanism having an upstream and downstream portion, that transmits the rotational force in a second transmitting direction, a first idling mechanism, and a second idling mechanism. When the motor transitions between rotating in the first direction and rotating in the second direction, the first idling mechanism allows the upstream portion of the first transmitting mechanism to perform an idle rotation with respect to the downstream portion of the first transmitting mechanism, and the second idling mechanism is configured to allow the upstream portion of the second transmitting mechanism to perform an idle rotation with respect to the downstream portion of the second transmitting mechanism.

24 Claims, 9 Drawing Sheets

SHEET FEED DEVICES AND IMAGE RECORDING APPARATUSES COMPRISING SUCH SHEET FEED DEVICES

CROSS-REFERENCE TO RELATED APPLICATION

The present application claims priority to Japanese Patent Application Publication No. JP-2008-094339, which was filed on Mar. 31, 2008, the disclosure of which is incorporated herein by reference in its entirety.

BACKGROUND OF THE INVENTION

1. Field of the Invention

The present invention generally relates to sheet feed devices that feed a sheet of recording medium stored in a tray in a predetermined direction and to an image recording apparatus comprising such sheet feed devices.

2. Description of Related Art

A known sheet feed device feeds sheets of recording medium stored in a tray to a recording unit one at a time while performing sheet separation. The sheet feed device comprises a feed mechanism. The feed mechanism comprises an arm supported on a shaft such that the arm pivots about the shaft in a pendulum motion, a feed roller rotatably attached at a free end of the arm, and gears rotatably supported in the arm. A rotational force of a motor is transmitted, via the gears, to the feed roller. When the feed roller rotates while contacting an uppermost one of the sheets stored in the tray, the uppermost sheet is fed in a predetermined direction. A separation member positioned downstream of the feed roller in the predetermined direction separates the uppermost sheet from a stack of sheets in the tray. Then, the uppermost sheet is fed to a recording unit.

SUMMARY OF THE INVENTION

A technical advantage of the invention is that a sheet of recording medium is selectively fed by a first roller from a first tray or by a second roller from a second tray by the change of rotation direction of a single motor, which is connected to the first roller and the second roller, while preventing erroneous sheet feeding.

According to an embodiment of the invention, a sheet feed device comprises a motor configured to selectively rotate in a first direction and a second direction opposite to the first direction, a first tray configured to store a first sheet therein, a second tray configured to store a second sheet therein, a first rotary member configured to feed the first sheet in a sheet feed direction, a second rotary member configured to feed the second sheet in the sheet feed direction, a first transmitting mechanism configured to transmit a rotational force of the motor in a first transmitting direction, wherein the first transmitting mechanism comprises an upstream portion connected to the motor, and a downstream portion connected to the first rotary member, a second transmitting mechanism configured to transmit the rotational force of the motor in a second transmitting direction, wherein the second transmitting mechanism comprises an upstream portion connected to the motor, and a downstream portion connected to the second rotary member, a first idling mechanism, and a second idling mechanism, wherein when the motor transitions between rotating in the first direction and rotating in the second direction, the first idling mechanism is configured to allow the upstream portion of the first transmitting mechanism to perform an idle rotation with respect to the downstream portion of the first transmitting mechanism, and the second idling mechanism is configured to allow the upstream portion of the second transmitting mechanism to perform an idle rotation with respect to the downstream portion of the second transmitting mechanism.

In another embodiment of the invention, a sheet feed device comprises a motor configured to rotate in a first direction and a second direction opposite to the first direction, a first tray configured to store a first sheet therein, a second tray configured to store a second sheet therein, a first rotary member configured to contact the sheet in the first tray and to feed the sheet in a sheet feed direction, a second rotary member configured to contact the sheet in the second tray and to feed the sheet in the sheet feed direction, a first transmitting mechanism comprising a first end connected to the motor and a second end opposite the first end connected to the first rotary member, the first transmitting mechanism comprising a first switching member configured to transmit a rotational force of the motor to the first rotary member when the motor rotates in the first direction and to interrupt transmission of the rotational force of the motor to the first rotary member when the motor rotates in the second direction, and a second transmitting mechanism comprising a first end connected to the motor and a second end opposite the first end connected to the second rotary member, the first transmitting mechanism comprising a second switching member configured to transmit the rotational force of the motor to the second rotary member when the motor rotates in the second direction and to interrupt transmission of the rotational force of the motor to the second rotary member when the motor rotates in the first direction.

In still another embodiment of the invention, an image recording apparatus comprises a sheet feed device comprising a motor configured to selectively rotate in a first direction and a second direction opposite to the first direction, a first tray configured to store a first sheet therein, a second tray configured to store a second sheet therein, a first rotary member configured to feed the first sheet in a sheet feed direction, a second rotary member configured to feed the second sheet in the sheet feed direction, a first transmitting mechanism configured to transmit a rotational force of the motor in a first transmitting direction, wherein the first transmitting mechanism comprises an upstream portion connected to the motor, and a downstream portion connected to the first rotary member, a second transmitting mechanism configured to transmit the rotational force of the motor in a second transmitting direction, wherein the second transmitting mechanism comprises an upstream portion connected to the motor, and a downstream portion connected to the second rotary member, a first idling mechanism, and a second idling mechanism, wherein when the motor transitions between rotating in the first direction and rotating in the second direction, the first idling mechanism is configured to allow the upstream portion of the first transmitting mechanism to perform an idle rotation with respect to the downstream portion of the first transmitting mechanism, and the second idling mechanism is configured to allow the upstream portion of the second transmitting mechanism to perform an idle rotation with respect to the downstream portion of the second transmitting mechanism. The image recording apparatus also comprises a recording unit configured to record an image on the sheet fed by the sheet feed device.

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-9, like numerals being used for like corresponding parts in the various drawings.

Figure 1:
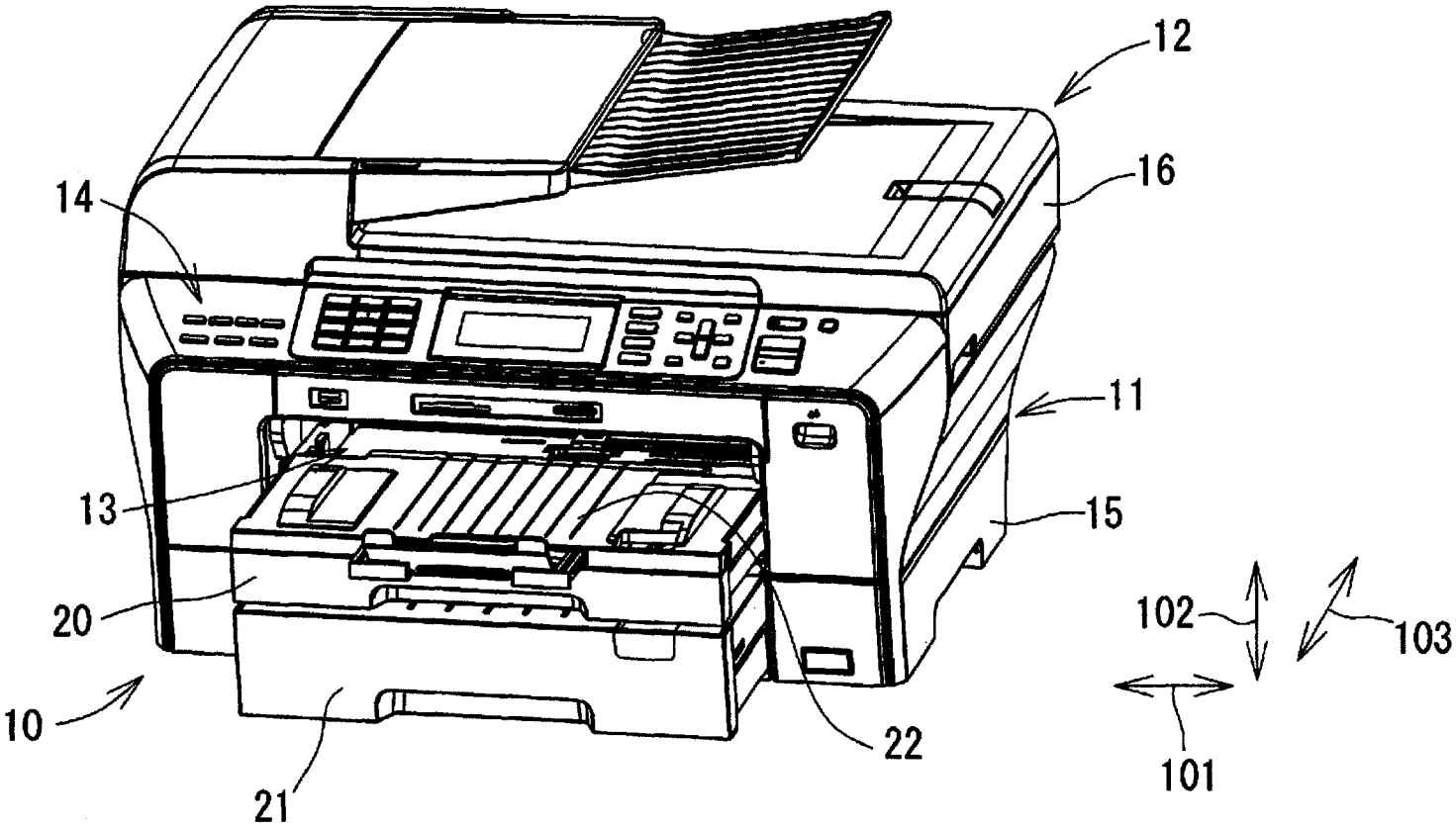
FIG. 1 is a perspective view schematically illustrating the general appearance of a multi-function device according to an embodiment of the invention.
Figure 2:
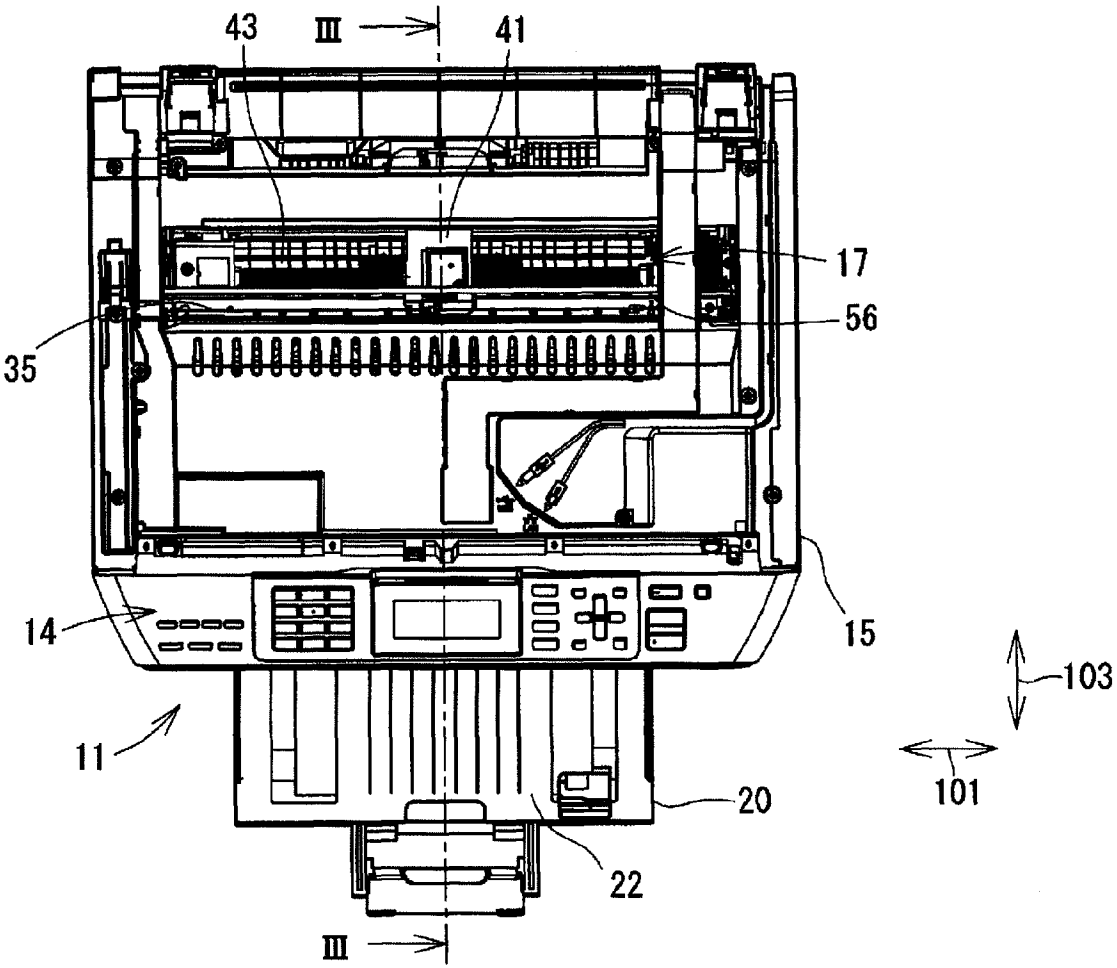
FIG. 2 is a top view schematically illustrating the general appearance of a printer according to an embodiment of the invention.

As illustrated in FIG. 1, an image recording apparatus, e.g., a multi-function device 10 includes a printer 11 and a scanner 12. The multi-function device 10 has a printing function, a scanning function, a copying function, and a facsimile function. Any function other than that of the printer 11 is an optional function that may be omitted. For example, the multi-function device 10 may not be provided with the scanner 12. That is, an image recording apparatus according to an embodiment of the invention may be a single-function printer that does not have a scanning function and a copying function.

The printer 11 is positioned at a lower portion of the multi-function device 10. The scanner 12 is disposes at an upper portion of the multi-function device 10. The printer 11 is connected to an external device, e.g., a computer. On the basis of print data that includes image data and text data transmitted from the external device, the printer 11 prints an image and text on a sheet of recording medium. The scanner 12 may be a so-called flatbed scanner.

The multi-function device 10 has the external shape of a substantially rectangular parallelepiped whose width and depth are greater than the height thereof. The height direction is indicated with a double-headed arrow 102 in the drawing. The width direction is indicated with a double-headed arrow 101 whereas the depth direction is indicated with a double-headed arrow 103 in the drawing. The external shape of the multi-function device 10 is mainly defined by the housing 15 of the printer 11 and the housing 16 of the scanner 12.

An opening 13 is formed at the front part of the housing 15 of the printer 11. A first tray 20 and a second tray 21 are positioned inside the opening 13. The first tray 20 and the second tray 21 have a two-tiered structure. The first tray 20 serves as the upper tray whereas the second tray 21 serves as the lower tray.

An operation panel 14 is positioned on the upper front part of the housing 15 of the printer 11. A user inputs various kinds of instructions through the manipulation of the operation panel 14 so as to operate the printer 11 and the scanner 12 in a desired manner. The operation panel 14 includes a plurality of input buttons and a display that shows the operation state, the error state, and the like, of the multi-function device 10. In addition to such manual instructions, if the multi-function device 10 is connected to an external information device, the multi-function device 10 operates according to instructions transmitted from the external information device via communication software such as a printer driver or a scanner driver.

Figure 3:
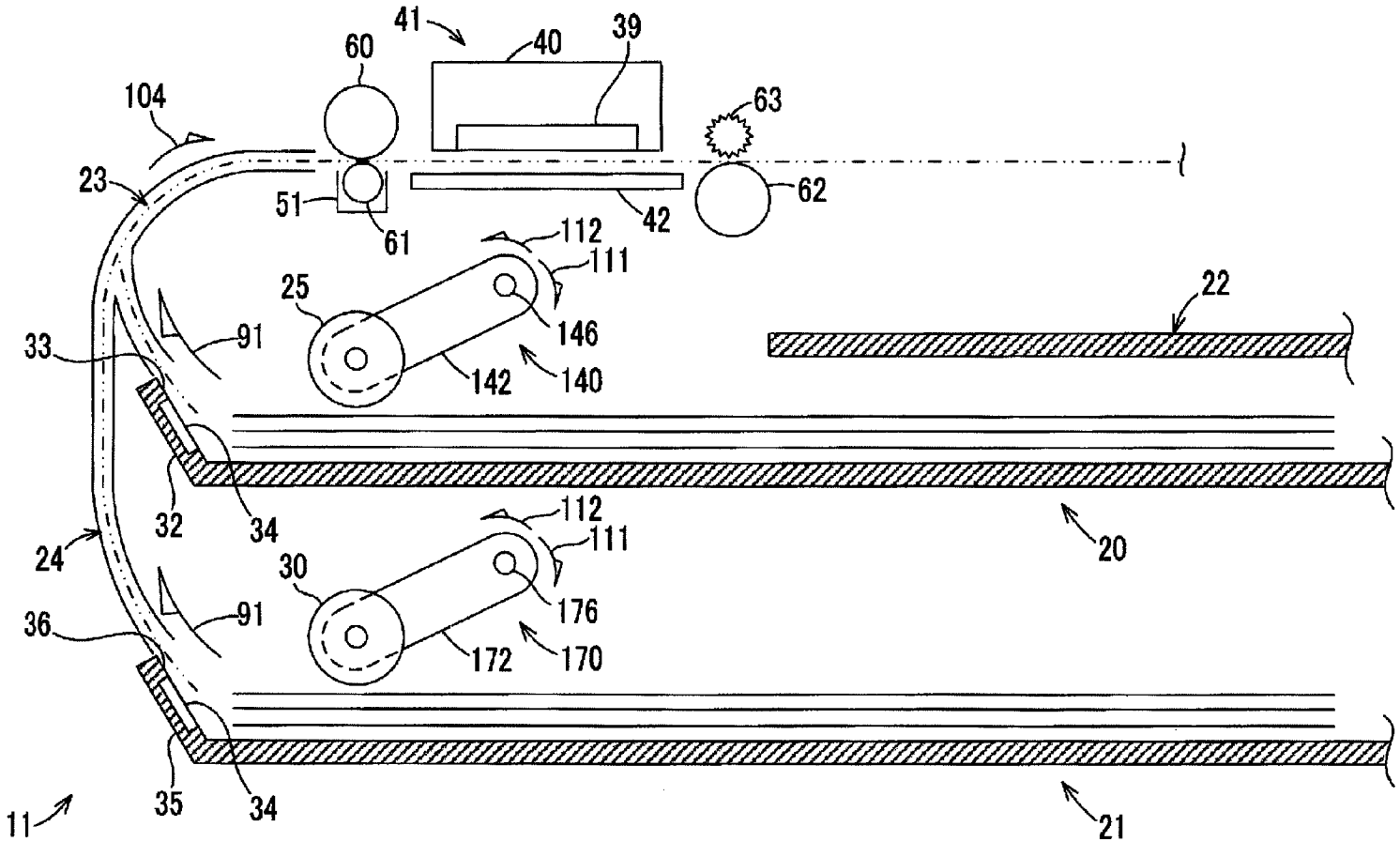
FIG. 3 is a sectional view taken along the line III-III of FIG. 2.

As illustrated in FIG. 3, a first convey path 23 extends between the first tray 20 and the upper surface 22 of the first tray 20 in such a manner that a sheet can be conveyed from the first tray 20 to the upper surface 22 thereof via the first convey path 23. A second convey path 24 extends between the second tray 21 and the upper surface 22 of the first tray 20 in such a manner that a sheet can be conveyed from the second tray 21 to the upper surface 22 of the first tray 20 via the second convey path 24. A first feed unit 140, a detailed explanation of which will be given later, feeds a sheet that is stored in the first tray 20. The sheet that has been fed from the first tray 20 is guided upward so as to make a U-turn along the first convey path 23. The sheet that has been guided along the first convey path 23 is conveyed to a recording unit 41. The recording unit 41 records an image on the sheet conveyed thereto. Thereafter, the recorded sheet is ejected onto the upper surface 22 of the first tray 20. A second feed unit 170 feeds a sheet that is stored in the second tray 21. The sheet that has been fed from the second tray 21 is guided upward along the second convey path 24 so as to make a U-turn. The sheet that has been guided upward along the second convey path 24 is conveyed to the recording unit 41. The recording unit 41 records an image on the sheet conveyed thereto. Thereafter, the recorded sheet is ejected onto the upper surface 22 of the first tray 20.

The first tray 20 has the shape of a container having an opening at the rear part of the printer 11. A stack of sheets is stored in the inner space of the first tray 20. The first feed roller 25 of the first feed unit 140 enters the inner space of the first tray 20 through the opening of the first tray 20 and contacts the upper surface of the uppermost one of sheets stored in the first tray 20. Sheets of A3 size or other sizes smaller than A3, which includes A4, B5, and postcard size, can be stored in the first tray 20. The upper surface 22 of the first tray 20 is positioned at the front part of the printer 11. Each recorded sheet is ejected onto the upper surface 22 of the first tray 20. Accordingly, the upper surface 22 of the first tray 20 functions as an output tray.

The second tray 21 has the shape of a container having an opening at the rear part of the printer 11. A stack of sheets is stored in the inner space of the second tray 21. The second feed roller 30 of the second feed unit 170 enters the inner space of the second tray 21 through the opening of the second tray 21 and contacts the upper surface of the uppermost one of sheets stored in the second tray 21. Sheets of A3 size or other sizes smaller than A3, which includes A4, B5, and postcard size, can be stored in the second tray 21. Sheets of a certain size and/or type that are different from the size and/or type of sheets that are stored in the first tray 20 can be stored in the second tray 21. By this means, it is possible to perform image recording on two sizes/types of sheets in a selective manner without the trouble of any sheet replacement in one feed cassette.

Figure 4:
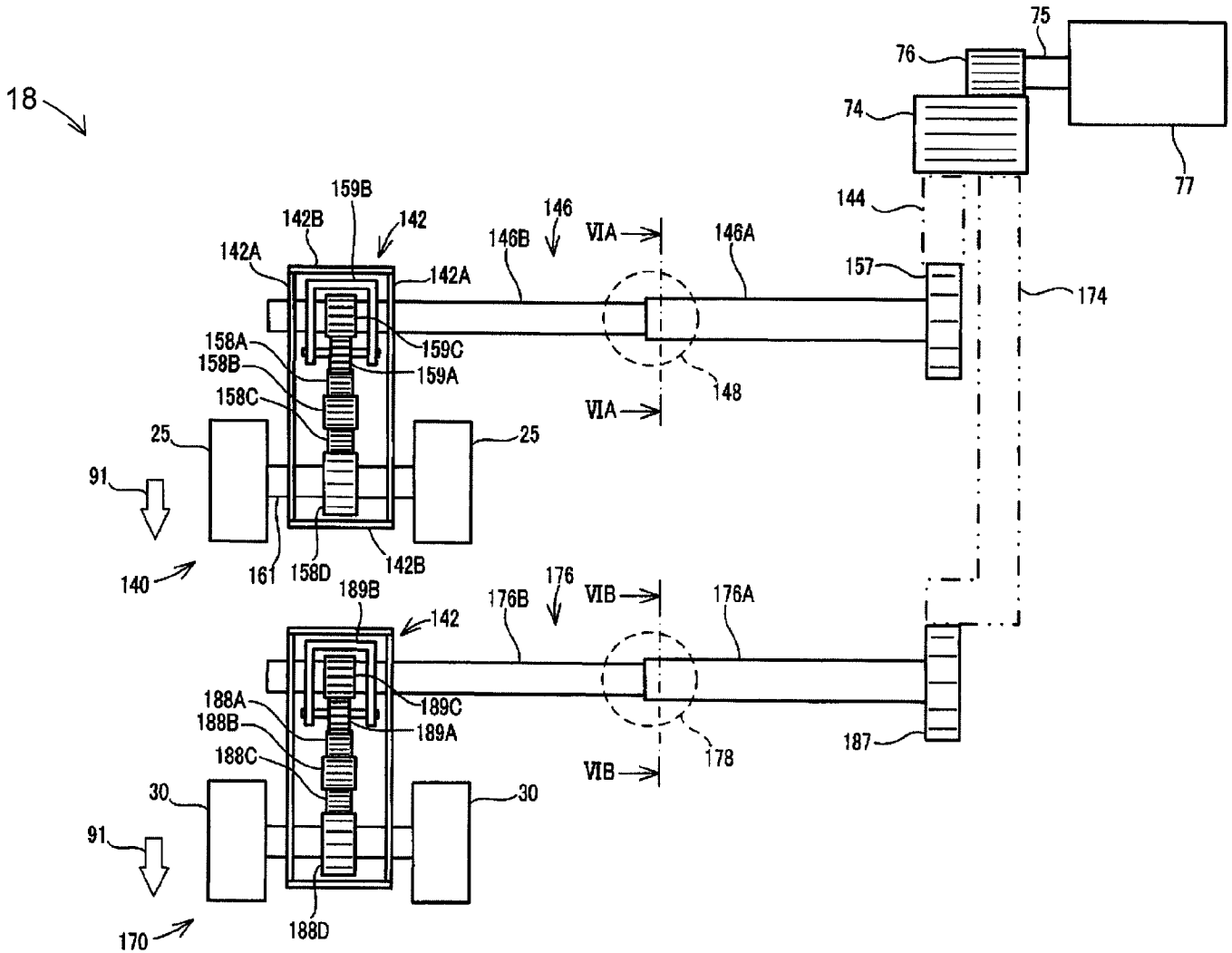
FIG. 4 is a diagram schematically illustrating a sheet feed mechanism according to an embodiment of the invention.

A sheet feed mechanism 18 that is illustrated in FIG. 4 is positioned at the rear part of the printer 11. The sheet feed mechanism 18 picks up a sheet from the first tray 20 or the second tray 21 and then feeds the sheet onto the first convey path 23 or the second convey path 24, respectively. The sheet feed mechanism 18 includes the first feed unit 140 and the second feed unit 170. As illustrated in FIG. 3, the first feed unit 140 is positioned over the first tray 20. Sheets stacked on the first tray 20 are fed into the first convey path 23 by the first feed unit 140 one after another. The second feed unit 170 is positioned over the second tray 21. Sheets stacked on the second tray 21 are fed into the second convey path 24 by the second feed unit 170 one after another. The configuration of the sheet feed mechanism 18 will be explained in detail later.

As illustrated in FIG. 3, an inclined plate 32 is positioned at the downstream end of the first tray 20 in a feeding direction 91 which is a right-to-left direction in FIG. 3. A separation member 34 is positioned on an inner surface 33 of the inclined plate 32. The separation member 34 has teeth that protrude in a direction perpendicular to the inner surface 33 of the inclined plate 32. The teeth of the separation member 34 are arrayed in a vertical direction. Similarly, an inclined plate 35 is positioned at the downstream end of the second tray 21 in the feeding direction 91, and another separation member 34 is positioned on an inner surface 36 of the inclined plate 35. When one or more sheets are fed from the first tray 20 and leading edges of the sheets contact the separation plate 32, the separation member 34 separates the uppermost sheet from the remaining lower sheets. Only the uppermost sheet is separated and guided upward by the inclined plate 32.

The first convey path 23 is formed above the inclined plate 32. A sheet guided upward by the inclined plate 32 is fed to the first convey path 23. The first convey path 23 extends upward from the downstream end of the first tray 20. Then, the first convey path 23 curves frontward. After the curve, the first convey path 23 extends from the rear of the multi-function device 10 toward the front thereof while passing the recording unit 41. Finally, the first convey path 23 leads to the upper surface 22 of the first tray 20. A part of the first convey path 23 is defined by an outer guide surface and an inner guide surface that are opposite to each other with a certain clearance left therebetween.

The second convey path 24 is formed above the inclined plate 35. A sheet guided upward by the inclined plate 35 is fed to the second convey path 24. The second convey path 24 extends from the downstream end of the second tray 20 to the upper surface 22 of the first tray 20 while passing the recording unit 41. The second convey path 24 merges with the first convey path 23 at a position upstream of the recording unit 41 in the conveying direction. A part of the second convey path 24 is defined by an outer guide surface and an inner guide surface that are opposite to each other with a certain clearance left therebetween.

As illustrated in FIG. 3, the recording unit 41 is positioned along the first convey path 23 and records an image on a sheet during the conveyance of the sheet on the first convey path 23. The recording unit 41 is provided with a carriage 40 and an inkjet recording head 39. A guide rail, which is not illustrated in the drawing, is positioned in such a manner that it extends in the direction of the width of the printer 11, which is indicated with the arrow 101 in FIG. 1. The carriage 40 is supported on the guide rail. When a carriage motor 67 (refer to FIG. 7) is driven, the carriage 40 travels (i.e., moves) in the width direction 101 along the guide rail. Instead of the ink-jet recording head 39, an electro-photographic recording head may be used.

A platen 42 is positioned under the lower surface of the recording unit 41 on the first convey path 23. The platen 42 supports the lower surface of a sheet that is conveyed along the first convey path 23. The platen 42 supports a sheet in such a manner that a certain gap is formed between the sheet and the lower surface of the recording head 39. Ink cartridges, which are not shown in the drawing, are positioned in the printer 11 separately from the recording head 39. Ink of a certain color is contained in each ink cartridge. Ink of various colors is supplied from these ink cartridges to the recording head 39 through respective ink tubes. During the reciprocating motion of the carriage 40, the recording head 39 selectively discharges droplets of ink of various colors toward the platen 42. In this way, an image is recorded on the sheet conveyed over the platen 42.

A convey roller 60 and a pinch roller 61 are positioned at a position upstream of the recording unit 41 and downstream of the first feed unit 140 and the second feed unit 170 in a conveying direction 104. The pinch roller 61 is positioned under the convey roller 60. The convey roller 60 is driven by a convey motor 70 (refer to FIG. 7). The angle of rotation of the conveyor roller 60 is detected by a rotary encoder 65 (refer to FIG. 7) positioned at the convey roller 60.

A sheet conveyed along the first convey path 23 or the second convey path 24 is pinched between the convey roller 60 and the pinch roller 61, and is further conveyed to an image recording position, which is between the recording head 39 and the platen 42. The pinch roller is rotated by the sheet being conveyed.

Figure 7:
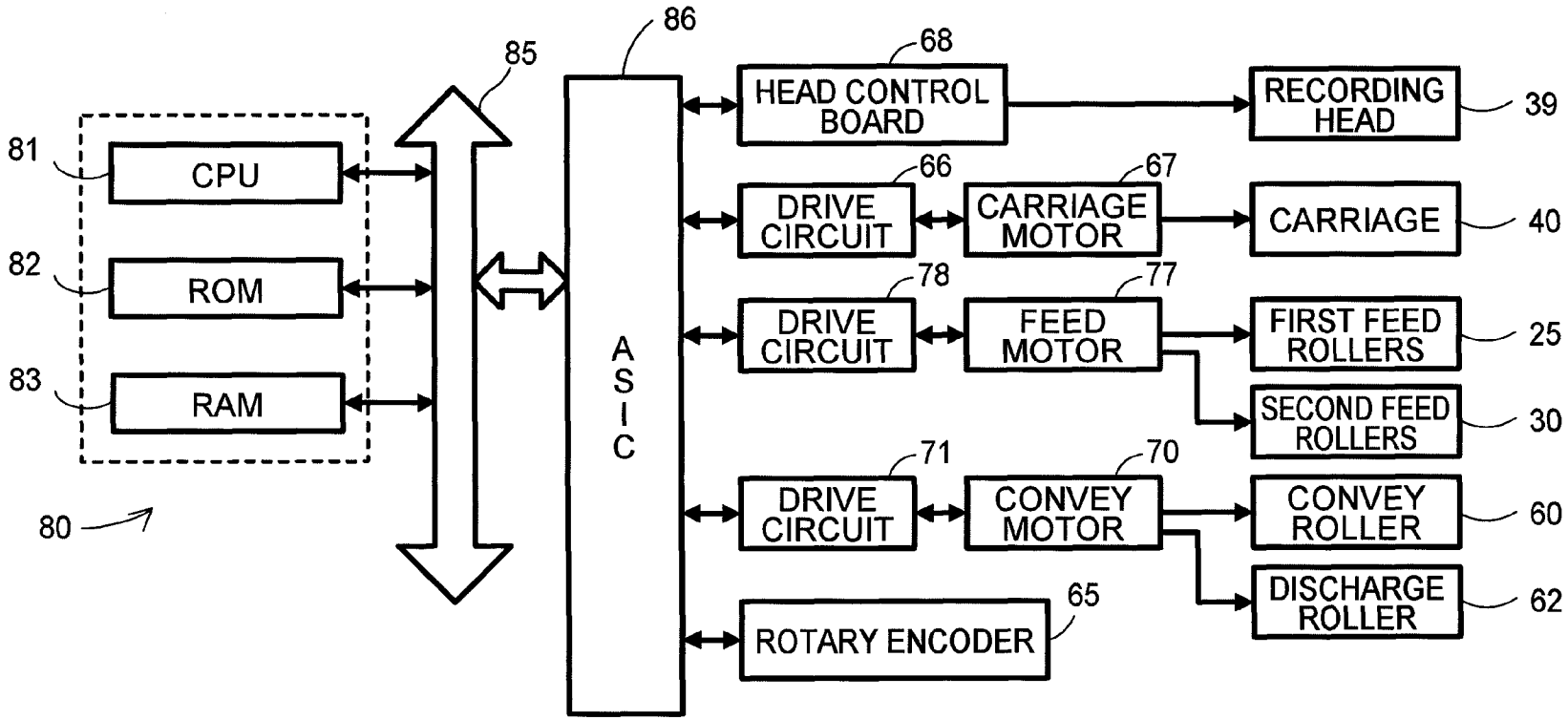
FIG. 7 is a block diagram schematically illustrating the configuration of a controller of the multi-function device of FIG. 1 according to an embodiment of the invention.

A discharge roller 62 and a spur 63 are positioned downstream of the recording unit 41 in the conveying direction 104. The spur is positioned above the discharge roller 62 and is urged by an elastic member to contact the discharge roller 62. The discharge roller 62 is driven by the convey motor 70, as shown in FIG. 7. The discharge roller 62 and the convey roller 60 rotate synchronously. The sheet having an image recorded thereon is discharged onto the upper surface 22 of the first tray 20 while being pinched by the discharge roller 62 and the spur 63.

As illustrated in FIG. 4, the sheet feed mechanism 18 comprises a feed motor 77, a first drive shaft 146, the first feed unit 140, a second drive shaft 176, the second feed unit 170, and gears. The feed motor 77 may rotate both in a forward rotation direction and a reverse rotation direction. The gears are positioned between the feed motor 77 and the first drive shaft 146, and also between the feed motor 77 and the second drive shaft 176.

The first drive shaft 146 is positioned above the first tray 20. The first drive shaft 146 has a substantially round bar shape. The first drive shaft 146 is supported on a frame that comprises at least a portion of the housing 15 of the printer 11. The first drive shaft 146 extends in the width direction of the multi-function device 10, e.g., the direction of arrow 101 in FIG. 1. The first drive shaft 146 rotates upon the reception of a rotational force transmitted from the feed motor 77 via the gears. The first drive shaft 146 transmits the rotational force to the first feed unit 140, which is positioned downstream of the first drive shaft 146 in a force transmission direction.

The first drive shaft 146 comprises a shaft segment 146A and a shaft segment 146B which are positioned upstream and downstream, respectively, in the force transmission direction. The upstream shaft segment 146A has a diameter greater than a diameter of the downstream shaft segment 146B. The shaft segment 146A and the shaft segment 146B are coupled to each other in the axial direction thereof. More specifically, the shaft segment 146A and the shaft segment 146B are coupled to each other at a coupling portion 148 with a predetermined clearance, e.g., play, that allows a predetermined angle of idle rotation of the shaft segment 146A with respect to the shaft segment 146B. The coupling, e.g., the idling mechanism, of the shaft segment 146A and the shaft segment 146B will be described in more detail herein.

Figure 5:
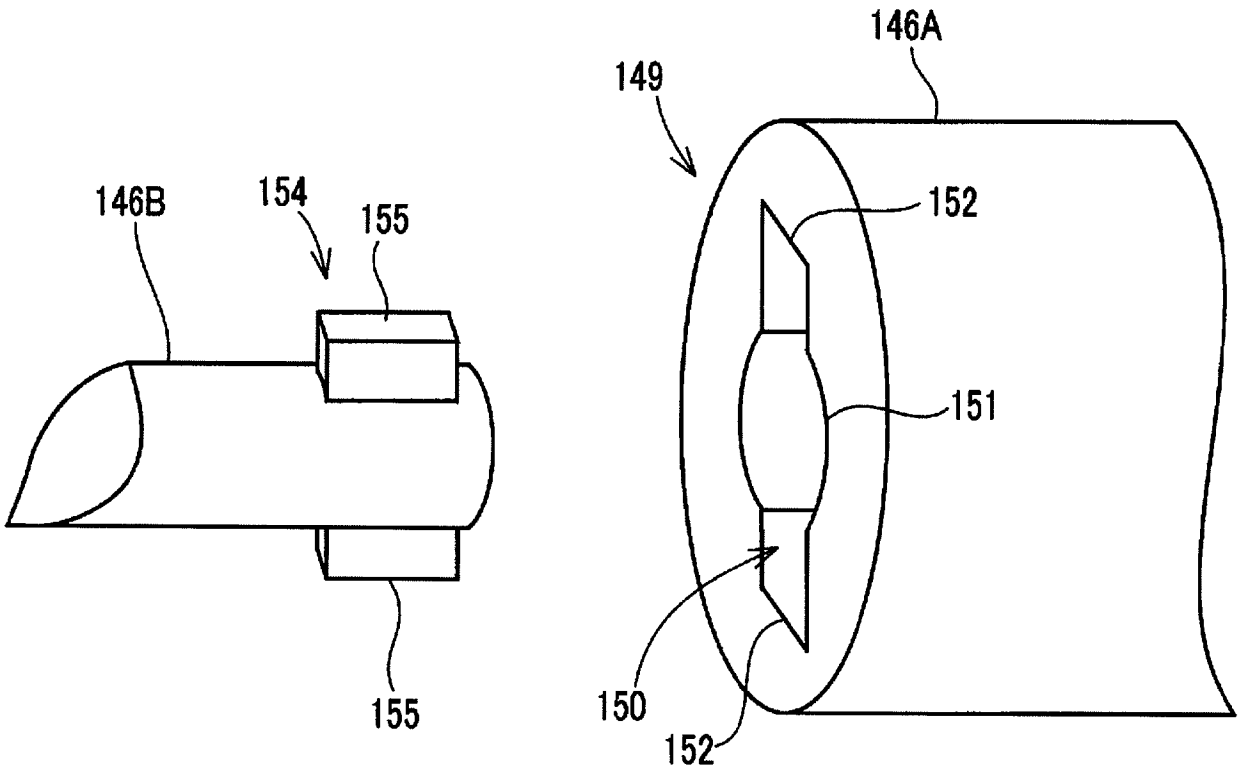
FIG. 5 is a perspective view schematically illustrating the structure of couplings according to an embodiment of the invention.

As illustrated in FIG. 5, the idling mechanism may comprise a coupling 149 formed at a coupling end of the shaft segment 146A and a coupling 154 formed at a coupling end of the shaft segment 146B. The coupling 154 of the shaft segment 146B is coupled to the coupling 149 of the shaft segment 146A. The coupling 154 of the shaft segment 146B is formed as two keys 155. The keys 155 are formed on the circumferential surface at the coupling end of the shaft segment 146B. The keys 155 protrude perpendicularly from the circumferential surface of the shaft segment 146B. The key 155 has a substantially thin rectangular parallelepiped shape. The key 155 is formed on the shaft segment 146B in such a manner that the elongated direction of the key 155 is parallel with the axial direction of the shaft segment 146B. More specifically, these keys 155 are spaced apart from each other at a circumferential angle of 180° on the circumferential surface of the shaft segment 146B. One side surface of one key 155 is flush with a corresponding one side surface of the other key 155.

In an embodiment of the invention, the keys 155 are formed as a molded part of the shaft segment 146B when the shaft segment 146B is made by molding synthetic resin or the like by an injection molding method. In another embodiment, key grooves may be formed in the circumferential surface of the shaft segment 146B so that the keys 155 can be fitted in the key grooves. In still another embodiment of the invention, the keys 155 may be screwed on the shaft segment 146B. The size of each key 155 and the number of the keys 155 may be modified depending on the required strength of the coupling portion 148, the coupling condition of the coupling portion 148, and other factors.

The coupling 149 of the shaft segment 146A may be formed as a keyhole 150. The keyhole 150 is formed in a coupling end face of the shaft segment 146A. The keyhole 150 may be formed as a combination of a circular groove 151 and two rectangular grooves 152. Each rectangular groove 152 extends outward from the inner surface of the circular groove 151. The circular groove 151 is large enough for the shaft segment 146B to be inserted therein. Specifically, the circular groove 151 is formed in such a size that the shaft segment 146B can rotate therein and that, when the shaft segment 146B is inserted in the circular groove 151, the axial center of the shaft segment 146A is aligned with the axial center of the shaft segment 146B. For example, the shaft segment 146B is coupled to the circular groove 151 using a clearance fit, e.g., a free fit or a movable fit.

These two rectangular grooves 152 may be formed at positions corresponding to the aforementioned two keys 155 of the coupling 154. The keys 155 are inserted in the rectangular grooves 152. As shown in FIG. 6, the rectangular groove 152 provides sufficient play, e.g., clearance L that allows the key 155 to be inserted therein. The play, e.g., clearance L may correspond to the maximum value L of angle by which the shaft segment 146A freely may make an idle rotation with respect to the shaft segment 146B. Hereinafter, such a value is interchangeably referred to as an "idle rotation angle L." In an embodiment of the invention, the keyhole 150 may have the structure set forth above. Thus, the shaft segment 146A may idle, e.g., move without transmitting any rotational force to the shaft segment 146B, by the idle rotation angle L, when the keys 155 and the shaft segment 146B are inserted in the keyhole 150.

The idle rotation angle L may be equal to or larger than a value used for releasing surface pressure between gears positioned in a force transmission path extending from the coupling portion 148 to the first feed roller 25. Thus, in an embodiment of the invention, the set value of the idle rotation angle L may be determined based on the number and size of gears positioned in the force transmission path, and the like.

In the above-described embodiment, the coupling 149 is formed in the shaft segment 146A while the coupling 154 is formed on the shaft segment 146B. In another embodiment of the invention, the couplings 149 and 154 may be reversed, such that the coupling 154 may be formed on the shaft segment 146A while the coupling 149 is formed in the shaft segment 146B.

Referring to FIG. 4, the first feed unit 140 may be attached to the shaft segment 146B. The first feed unit 140 is positioned at the downstream end of the shaft segment 146B in the force transmission direction. The downstream end of the shaft segment 146B is opposite to the coupling end of the shaft segment 146B. A rotational force is transmitted from the first drive shaft 146 to the first feed unit 140. Upon the reception of a rotational force from the first drive shaft 146, the first feed unit 140 feeds a sheet stored in the first tray 20 in the feeding direction 91.

The first feed unit 140 comprises a first arm 142, the first feed rollers 25, a plurality of transmission gears 158A, 158B, 158C, and 158D, and a planetary gear unit 159. Hereinafter, the plurality of transmission gears 158A, 158B, 158C, and 158D may be collectively and interchangeably referred to as transmission gears 158.

The first arm 142 of the first feed unit 140 may be formed above the first tray 20. The first feed rollers 25, the transmission gears 158, and the planetary gear unit 159 are mounted on the first arm 142. The first arm 142 includes a pair of plate members 142A and a pair of ribs 142B. The plate members 142A face each other with a gap space left therebetween. Each rib 142B spans between one end of one plate member 142A and the corresponding one end of the other plate member 142A. The transmission gears 158 and the planetary gear unit 159 are positioned in the space between the pair of plate members 142A.

The base end of the first arm 142 is pivotally supported on the shaft segment 146B. As illustrated in FIG. 3, the first arm 142 extends from the first drive shaft 146 toward the upper surface of the first tray 20. That is, the first arm 142 extends obliquely downward from the first drive shaft 146 such that the lower end of the first arm 142 is positioned at the downstream side of the first tray 20 in the feeding direction 91. The first feed rollers 25 are rotatably supported at the free end of the first arm 142.

The first feed rollers 25 rotate while contacting the upper surface of the uppermost one of the sheets stored in the first tray 20 and feed the uppermost sheet in the feeding direction 91. The first feed rollers 25 are rotatably supported on a roller shaft 161 positioned at the free end of the first arm 142. The roller shaft 161 extends parallel with the axial direction of the first drive shaft 146. As illustrated in FIG. 4, the two first feed rollers 25 are attached to the corresponding ends of the roller shaft 161. The transmission gear 158D is positioned at the center of the roller shaft 161.

The planetary gear unit 159 transmits a rotational force transmitted from the shaft segment 146B to the transmission gear 158A. The planet gear unit 159 includes a planet gear 159A, a support arm 159B, and a sun gear 159C. The sun gear 159C may be integrally formed with the shaft segment 146B. The sun gear 159C may directly receive the rotational force of the shaft segment 146B. The sun gear 159C is positioned in the vicinity of one end of the first drive shaft 146, e.g., shaft segment 146B, that is opposite to the other end at which a transmission gear 157 is positioned. For example, the sun gear 159C may be formed as circumferential teeth around the shaft segment 146B. In another embodiment, the sun gear 159C may be a separate member from the shaft segment 146B and may be fixed to the shaft segment 146B.

One end of the support arm 159B is supported on the shaft segment 146B in such a manner that the support arm 159B can pivot about the one end. The planet gear 159A is rotatably supported on the opposite end of the support arm 159B. The support arm 159B ensures that the planet gear 159A and the sun gear 159C are tightly engaged with each other.

The transmission gear 157 is provided at the upstream end of the shaft segment 146A in the force transmission direction. The upstream end of the shaft segment 146A is opposite to the coupling end of the shaft segment 146A. When the transmission gear 157 rotates, the shaft segment 146A rotates in the same direction as the rotation direction of transmission gear 157. A first gear train 144, which comprises one or more gears that mesh with one another, is coupled to the transmission gear 157. The most upstream gear of the first gear train 144 in the force transmission direction meshes with a branch gear 74. The branch gear 74 meshes with an output gear 76, which is fixed to the output shaft 75 of the feed motor 77. The first gear train 144 is configured such that the first drive shaft 146 rotates in a counterclockwise direction 112 shown in FIG. 3 when the feed motor 77 rotates in a first direction, and the first drive shaft 146 rotates in a clockwise direction 111 shown in FIG. 3 when the feed motor 77 rotates in a second direction, which is opposite to the first direction.

The branch gear 74 branches the rotational force transmitted from the feed motor 77, via the output gear 76, to the first gear train 144 or to a second gear train 174, both of which are positioned downstream of the branch gear 74 in the force transmission direction. Second gear train 174 will be described in more detail herein. Accordingly, the branch gear 74 is positioned at a point to branch a transmission path from the feed motor 77 into two transmission paths, one of which leads to the first feed rollers 25 and the other of which leads to the second feed rollers 30.

The second drive shaft 176 is positioned above the second tray 21. The configuration of the second drive shaft 176 is substantially the same as that of the first drive shaft 146 explained above. Therefore, a detailed explanation of the operation and configuration of the second drive shaft 176 is omitted. The second drive shaft 176 rotates upon the reception of a rotational force transmitted from the feed motor 77 via the second gear train 174 and a transmission gear 187. The second drive shaft 176 transmits the rotational force transmitted from the feed motor 77 to the second feed unit 170, which is positioned downstream of the second drive shaft 176 in the force transmission direction.

The second drive shaft 176 includes a shaft segment 176A and a shaft segment 176B, which are positioned upstream and downstream sides, respectively, in the force transmission direction. Referring to FIG. 5, the shaft segment 176A has the coupling 149, as does the shaft segment 146A. The shaft segment 176B has the coupling 154 as does the shaft segment 146B. The structure of the couplings 149 and 154 of the second drive shaft 176 is similar to the structure of the couplings 149 and 154 of first drive shaft 146, and is not further described herein.

When the shaft segment 146A of the first drive shaft 146 rotates, the planet gear 159A selectively contacts or moves away from the transmission gear 158A depending on the rotation direction of the shaft segment 146A. When the shaft segment 176A of the second drive shaft 176 rotates, a planet gear 189A selectively contacts or moves away from a transmission gear 188A depending on the rotation direction of the shaft segment 176A. When the feed motor 77 rotates in the first direction, the shaft segment 146A of the first drive shaft 146 rotates in the counterclockwise direction 112 shown in FIG. 3. At this time, the shaft segment 176A of the second drive shaft 176 rotates in the clockwise direction 111 shown in FIG. 3.

Figure 6B:
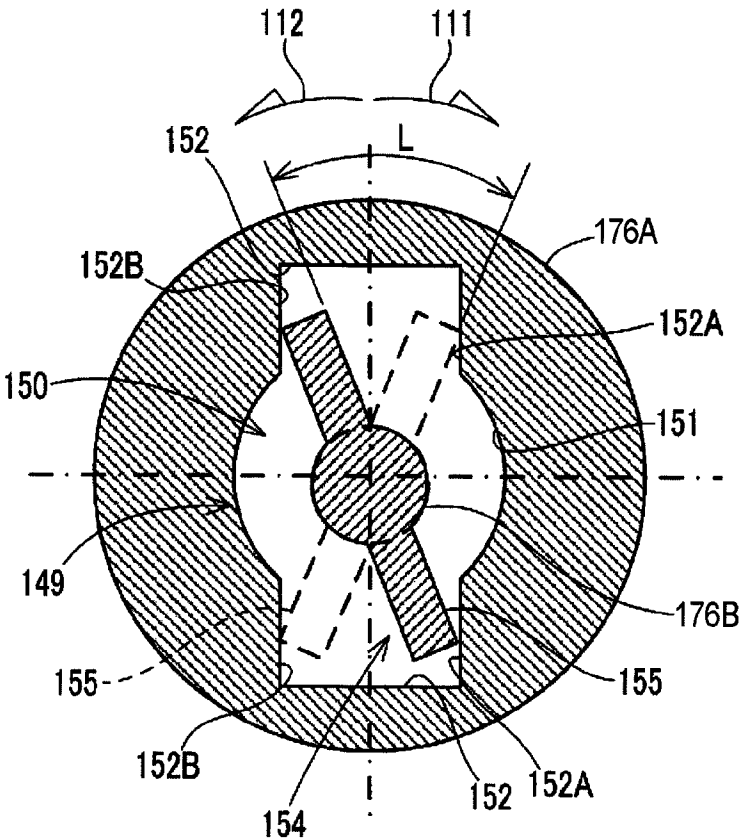
FIGS. 6A and 6B are sectional views of the structure of couplings, each view schematically illustrating the position of a key of one of the couplings of FIG. 5 relative to the other coupling.
Figure 6A:
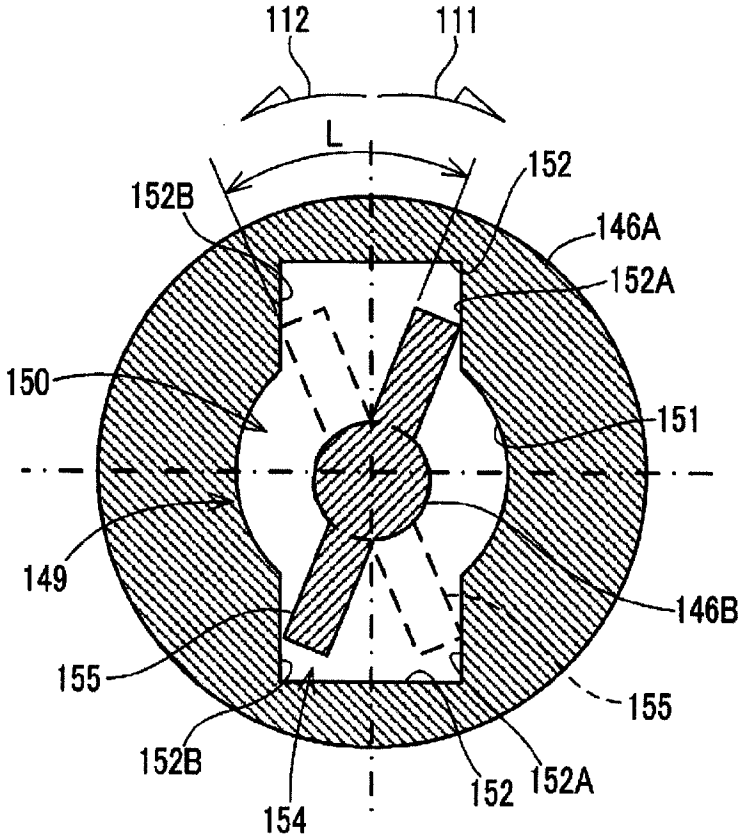

Referring to FIG. 6A, when the shaft segment 146A of the first drive shaft 146 rotates in the counterclockwise direction 112, the shaft segment 146A makes an idle rotation by the idle rotation angle L. After the idle rotation of the shaft segment 146A, as shown by a solid line in FIG. 6A, one edge 152A of the rectangular groove 152 of the shaft segment 146A contacts the key 155 of the shaft segment 146B. Referring again to FIG. 4, the shaft segment 146B then rotates in the counterclockwise direction 112. The sun gear 159C rotates on the axis of the first drive shaft 146 in the counterclockwise direction 112. Then, the planet gear 159A moves in the counterclockwise direction 112 around the sun gear 159C. The planet gear 159A contacts the transmission gear 158A so as to mesh therewith. As a result, the rotational force of the first drive shaft 146 is transmitted to the transmission gear 158A, via the planet gear 159A. The rotational force is further transmitted from the transmission gear 158A to the transmission gears 158B, 158C, and 158D in this order. Then, the rotational force is finally transmitted to the first feed rollers 25. Upon the reception of the rotational force, the first feed rollers 25 may start rotating, which may feed a sheet in the feeding direction 91.

When the shaft segment 176A of the second drive shaft 176 rotates in the clockwise direction 111, the shaft segment 176A makes an idle rotation of the idle rotation angle L. After the idle rotation of the shaft segment 176A, as shown by a solid line in FIG. 6B, the other edge 152B of the rectangular groove 152 of the shaft segment 176A contacts the key 155 of the shaft segment 176B. Then, the shaft segment 176B rotates in the clockwise direction 111. The sun gear 189C then rotates on the axis of the second drive shaft 176 in the clockwise direction 111. Then, the planet gear 189A moves in the clockwise direction 111 around the sun gear 189C. The planet gear 189A moves away from the transmission gear 188A. As a result, transmission of the rotational force from the second drive shaft 176 to the transmission gear 188A may be stopped because of a disconnection between the second drive shaft 176 and the transmission gear 188A, and the second feed rollers 30 may stop rotating.

Next, when the feed motor 77 rotates in the second direction, the shaft segment 146A of the first drive shaft 146 rotates in the clockwise direction 111 shown in FIG. 3. At this time, the shaft segment 176A of the second drive shaft 176 rotates in the counterclockwise direction 112 shown in FIG. 3.

When the shaft segment 146A of the first drive shaft 146 rotates in the clockwise direction 111, the shaft segment 146A makes an idle rotation by the idle rotation angle L. After the idle rotation of the shaft segment 146A, as shown by a broken line in FIG. 6A, the other edge 152B of the rectangular groove 152 of the shaft segment 146A contacts the key 155 of the shaft segment 146B. Then, the shaft segment 146B rotates in the clockwise direction 111. The sun gear 159C rotates on the axis of the first drive shaft 146 in the same direction 111. Then, the planet gear 159A moves in the clockwise direction 111 around the sun gear 159C. The planet gear 159A moves away from the transmission gear 158A. As a result, transmission of the rotational force from the first drive shaft 146 to the transmission gear 158A is stopped because of a disconnection between the first drive shaft 146 and the transmission gear 158A. Therefore, the first feed rollers 25 stop rotating.

When the shaft segment 176A of the second drive shaft 176 rotates in the counterclockwise direction 112, the shaft segment 176A makes an idle rotation by the idle rotation angle L. After the idle rotation of the shaft segment 176A, as shown by a broken line in FIG. 6B, one edge 152A of the rectangular groove 152 of the shaft segment 176A contacts the key 155 of the shaft segment 176B. Then, the shaft segment 176B rotates in the counterclockwise direction 112. The sun gear 189C rotates on the axis of the second drive shaft 176 in the same direction 112. Then, the planet gear 189A moves in the counterclockwise direction 112 around the sun gear 189C. The planet gear 189A contacts the transmission gear 188A so as to mesh therewith. As a result, the rotational force of the second drive shaft 176 is transmitted to the transmission gear 188A, via the planet gear 189A. The rotational force is further transmitted from the transmission gear 188A to the transmission gears 188B, 188C, and 188D in this order. Then, the rotational force is finally transmitted to the second feed rollers 30. Upon the reception of the rotational force, the second feed rollers 30 start rotating so as to feed a sheet in the feeding direction 91.

Referring to FIG. 7, the controller 80 may control the printer 11, the scanner 12 or both. The controller 70 may comprise a CPU ("central processing unit") 81, a ROM ("read only memory") 82, and a RAM ("random access memory") 83. The controller 80 may be connected to one or more sensors, scanner 12, operation panel 14, and others, via a bus 85 and an ASIC ("application specific integrated circuit") 86, such that data may be transmitted between components.

The ROM 82 may store programs for controlling operations of the multi-function device 10. Using one or more of the programs stored in the ROM 82, the controller 80 may determine whether a sheet is jammed based on signals of a rotary encoder 65 and other sensors, may control the rotation directions of the feed motor 77 and the convey motor 70, and may control the rotation angles of the feed motor 77 and the convey motor 70. The RAM 83 may be a memory area or a work area in which various data used by the CPU 81 to execute the programs stored in the ROM 83 is temporarily recorded. The ASIC 86 may generate a control signal to be applied to the feed motor 77 in response to a command from the CPU 81. The ASIC 86 may apply the control signal to a drive circuit 78 of the feed motor 77. The controller 80 may control the rotation of the feed motor 77 by a drive signal applied to the feed motor 77 via the drive circuit 78.

The drive circuit 78 may be used to drive the feed motor 77 connected to the feed roller 25 and the feed roller 30. The drive circuit 78 may generate an electrical signal for rotating the feed motor 77 in the first direction or the second direction based on an output signal from the ASIC 76. The feed motor 77, upon receipt of the electrical signal, rotates in the instructed direction. The rotation of the feed motor 77 may be transmitted to the feed roller 25 or the feed roller 30 via a drive mechanism comprising a gear and a drive shaft.

The ASIC 86 also may generate a control signal to be applied to the convey motor 70 in response to a command from the CPU 81, and may apply the control signal to a drive circuit 71 of the convey motor 70. The controller 80 may control rotation of the convey motor 70 by a drive signal applied to the convey motor 79 via the drive circuit 71.

The drive circuit 71 may drive the convey motor 70 connected to the convey roller 60. The drive circuit 71 may generate an electrical signal for rotating the convey motor 70 in a predetermined direction based on an output signal from the ASIC 86. The convey motor 70, upon receipt of the electrical signal, rotates in the predetermined direction. The rotation of the convey motor 70 may be transmitted to the convey roller 60 via a drive mechanism comprising a gear and a drive shaft.

The ASIC 86 also may generate a control signal to be applied to the carriage motor 67 in response to a command from the CPU 81, and may apply the control signal to a drive circuit 66 of the carriage motor 67. The controller 80 may control rotation of the carriage motor 67 by a drive signal applied to the carriage motor 67 via the drive circuit 66.

The drive circuit 66 may drive the carriage motor 67 coupled to the carriage 40. The drive circuit 66 may generate an electrical signal for rotating the carriage motor 67 based on an output signal from the ASIC 86. The rotation of the carriage motor 67 may be transmitted to the carriage 40 via a belt driving mechanism to move the carriage 40. The head control board 68 may drive the recording head 39 to eject ink of various colors onto the sheet at predetermined timings. The ASIC 86 may generate an output signal for driving the recording head 39 based on a command from the CPU 81. The head control board 68, upon receipt of the output signal, controls the recording head 39.

The ASIC 86 may be connected to the rotary encoder 65 that detects the rotation angle of the convey roller 60. A signal generated by the rotary encoder 65 is sent from the ASIC 86 to the CPU 81 via the bus 85. The CPU 81 determines whether a sheet is jammed by detecting an erroneous operation of the convey roller 60 based on the signal of the rotary encoder 65.

Figure 8:
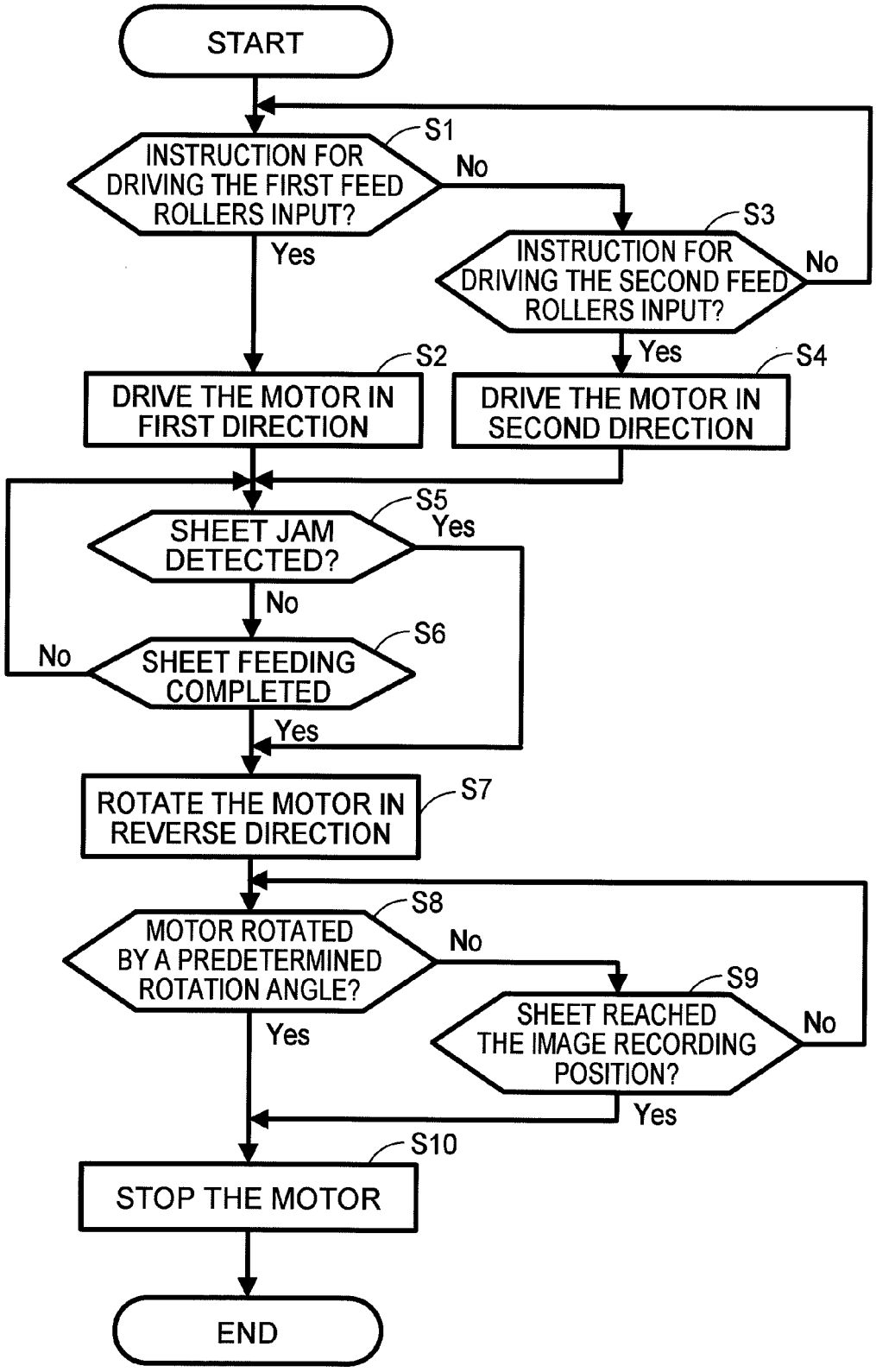
FIG. 8 is a flowchart illustrating a control executed by a CPU of the controller of FIG. 7 to drive the feed motor of FIG. 4, according to an embodiment of the invention.

FIG. 8 illustrates an example of a control process for driving the feed motor 77, which is executed by the CPU 81 of the controller 80, according to an embodiment of the invention.

At Step S1, the CPU 81 determines whether an instruction signal for driving the first feed roller 25 is input to the controller 80. For example, when the first tray 20 is selected via a printer driver or the like, an instruction signal for driving the first feed roller 25, which feeds a sheet from the first tray 20, is input to the controller 80 along with a print command. If affirmative, e.g., "YES" at Step S1, then at Step S2, CPU 81 may issue an instruction signal to drive the feed motor 77 in the first direction. Specifically, the CPU 81 may output a drive signal for rotating the feed motor 77 in the first direction to the drive circuit 78. If negative, e.g., "NO" at Step S1, then processing moves to Step S3. At Step S3, if an instruction signal for driving the second feed rollers 30 is input at Step S3, e.g., "YES" at Step S3, then at Step S4, CPU 81 may output a drive signal to drive the feed motor 77 in the second direction. Specifically, the CPU 81 may output a drive signal for rotating the feed motor 77 in the second direction. If an instruction signal for driving the second feed rollers 30 is not input at Step S3, e.g., "NO" at Step S3, then processing returns to Step S1.

If processing moves to Step S2, then at Step S2, when the feed motor 77 is driven to rotate in the first direction, the first feed rollers 25 of the first feed unit 140 feed a sheet from the first tray 20. If processing moves to Step S4, then at Step S4, when the feed motor 77 is driven to rotate in the second direction, the second feed rollers 30 of the second feed unit 170 feed a sheet from the second tray 21.

From both Step S2 and Step S4, processing may continue to Step S5. At Step S5, the CPU 81 detects whether a sheet fed from the first tray 20 or the second tray 21 is jammed based on an output signal of the rotary encoder 65. If the CPU 81 detects that a sheet is jammed, e.g. "YES" at Step S5, then the CPU 81 may output a stop signal to the drive circuit 78 for the feed motor 77. Then, the processing moves to Step S7.

If the CPU detects that no sheet is jammed, e.g. "NO" at Step S5, then processing moves to Step S6. At Step S6, the CPU determines whether sheet feeding is completed. Specifically, when the leading edge of a sheet fed by the first feed rollers 25 or the second feed rollers 30 reaches the convey roller 60, which is then enabled to convey the sheet, the CPU 81 outputs a stop signal to the drive circuit 78 for the feed motor 77, which may temporarily stop the first feed roller 25 or the second feed roller 30. The CPU 81 outputs a stop signal for a sheet that is fed alone, as well as for each one of a plurality of sheets consecutively fed, such that a predetermined interval may be provided between a particular sheet and the next sheet. When the CPU 81 outputs such stop signal, the CPU 81 may determine that sheet feeding is completed at Step S6, e.g. "YES" at Step S6. When sheet feeding is not completed, e.g., "NO" at Step S6, processing may loop from Step S6 to Step S5 until sheet feeding is completed at Step S6.

At Step S7, the CPU 81 may reverse the rotation direction of the feed motor 77. For example, when the first feed rollers 25 feed a sheet from the first tray 20, the rotation direction of the feed motor 77 may change to the second direction. Alternatively, when the second feed rollers 30 feed a sheet from the second tray 21, the rotation direction of the feed motor 77 may change to the first direction. Processing then may continue to Step S8.

At Step S8, the CPU 81 determines whether the feed motor 77 is rotated in a direction opposite to the previous rotation direction by a predetermined rotation angle. The predetermined rotation angle of the feed motor 77 corresponds to predetermined idle rotation angles of the first shaft segment 146A and the second shaft segment 176A, which may be equal to the above-described idle rotation angle L, or may be less than the idle rotation angle L, in embodiments in which such lesser angle is sufficient for releasing surface pressure between the gears positioned between the coupling portion 148 and the first feed rollers 25, or between the coupling portion 178 and the second feed rollers 30.

In addition, the predetermined rotation angle of the feed motor 77 may be set with bounds such that when sheet feeding is stopped from one of the trays 20, 21, it may not cause sheet feeding from the other of trays 20, 21. In an embodiment of the invention, the determination at Step S8 may be made based on an output signal of a sensor, e.g., a rotary encoder, for detecting the rotation angle of the feed motor 77. In another embodiment of the invention, at Step S8, the CPU 81 may determine whether a predetermined driving time, which may correspond to the predetermined idle rotation angle, has elapsed.

If the determination at Step S8 is affirmative, e.g. "YES" at Step S8, processing may proceed to Step S1. If the determination at Step S8 is negative, e.g. "NO" at Step S8, then processing moves to Step S9. At Step S9, the CPU 81 determines whether a sheet being fed has reached an image recording position. If the determination of CPU 81 is affirmative, e.g., "YES" at Step S9, then processing moves to Step S10. At Step S10, CPU 81 may stop the feed motor 77. At Step S10, the CPU 81 forcibly may stop the feed motor 77 once the sheet reaches the image recording position, regardless of whether the feed roller 77 is rotated by the predetermined idle rotation angle. When the sheet being fed has not reached an image recording position, e.g., "NO" at Step S9, processing may loop from Step S9 to Step S8 until the sheet being fed has reached an image recording position at Step S9.

Figure 9:
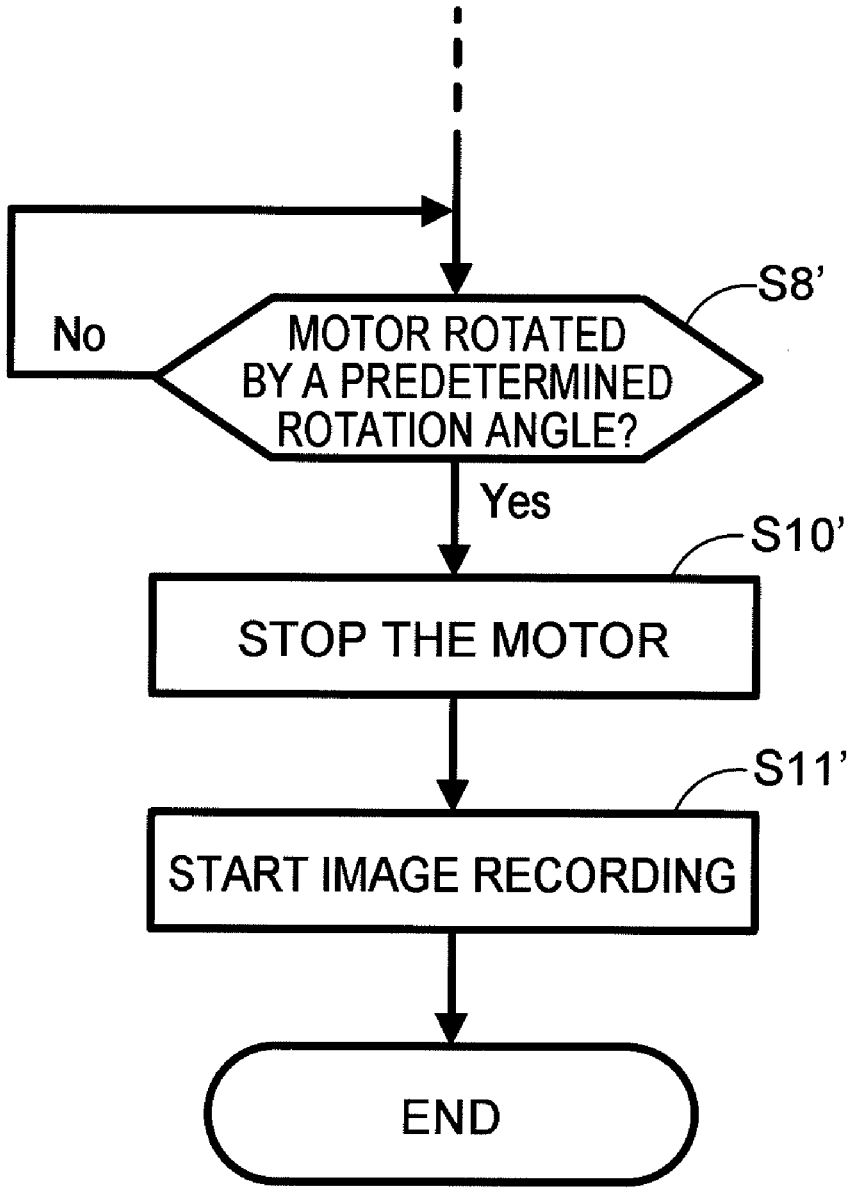
FIG. 9 is a flowchart illustrating a control executed by a CPU of the controller of FIG. 7 to drive the feed motor of FIG. 4, according to another embodiment of the invention.

In the above-described process, the CPU 81 forcibly may stop the feed motor 77 when the sheet reaches the image recording position before the feed motor 77 is rotated by the predetermined idle rotation angle. Nevertheless, in another embodiment of the invention, as shown in FIG. 9, the process from Step S8 and subsequent steps may be replaced with Steps S8', S10' and S11'. At Step S8', the CPU 81 may determine whether the feed motor 77 is rotated by the predetermined idle rotation angle. Step S8' may repeat until the CPU determines that the feed roller 77 is rotated by the predetermined idle rotation angle. At this time, even when the sheet reaches the image recording position before the feed motor 77 is rotated by the predetermined idle rotation angle, the CPU 81 may prohibit image recording from starting. If the determination is affirmative at Step S8', e.g., "YES" at Step S8', processing may move to Step S10', and the CPU 81 may stop the feed motor 77. Then, processing may move to Step S11'. At Step S11', CPU 81 may permit image recording to be started.

In the process according to this embodiment, the CPU 81 may rotate the feed motor 77 in a direction opposite to the previous rotation direction by the predetermined idle rotation angle, after the convey roller 60 is enabled to convey the sheet, and before image recording is started.

In the above embodiments illustrated in FIGS. 8 and 9, before the feed motor 77 stops, the feed motor 77 may rotate in a direction opposite to the previous rotation direction, and the shaft segment 146A makes an idle rotation with respect to the shaft segment 146B at the coupling portion 148. Similarly, the shaft segment 176A makes an idle rotation with respect to the shaft segment 176B at the coupling portion 178. The feed motor 77 may be rotating in the first direction to feed the sheet from the first tray 20. Before the feed motor 77 stops, the feed motor 77 may rotate in the second direction by the predetermined rotation angle, and the shaft segment 146A may make an idle rotation in such a direction as to disengage from the shaft segment 146B. Thus, a surface pressure of the gears extending from the coupling portion 148 to the feed rollers 25 may be released.

Accordingly, pressing force of the feed rollers 25 against the sheets stored in the first tray 20 may be reduced. This may prevent the sheets in the tray 20, 21 from adhering to each other due to the load applied by the feed rollers 25. Consequently, an occurrence of two or more sheets fed at a time when sheet feeding is restarted may be reduced.

Even if a leading edge of any of the sheets in the first tray 20 is leaning on the inclined plate 32 when the feed motor 77 stops, the leading edge of the sheet may be prevented from bending to move away from the separation member 34 due to the load applied by the feed rollers 25. Consequently, an occurrence of two or more sheets fed at a time may be reduced or eliminated.

In the above-described processes, when the sheet is jammed in the convey path 23, 24, the feed motor 77 stops after rotating by the predetermined rotation angle in a direction opposite to the previous rotation direction. Because the pressing force of the feed rollers 25, 30 is reduced, the tray 20, 21 which receives the load from the feed rollers 25, 30 more easily may be withdrawn from the housing 15.

Moreover, when the feed motor stops rotating, such that no sheet is fed from one of the trays 20, 21, no sheet is fed either from the other tray when the feed motor 77 rotates, before stopping, in a direction opposite to the previous direction by the predetermined rotation angle. For example, when the feed motor 77 changes its rotation from the first direction to the second direction before the feed motor 77 stops, the shaft segment 176A makes an idle rotation with respect to the shaft segment 176B, and thus no sheet is fed from the second tray 21.

In an embodiment of the invention, the idle rotation angle L for the shaft segment 146A may be equal to the idle rotation angle L for the shaft segment 176A. Nevertheless, in another embodiment the idle rotation angle L may be set differently for the different shaft segments depending on the structure of the sheet feed mechanism. In an embodiment of the invention, shaft couplings 149, 154 may be used as an idling mechanism. Nevertheless, in another embodiment of the invention, other couplings, e.g., rubber couplings and resin bellows couplings may be used.

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. A sheet feed device comprising:

a motor configured to selectively rotate in a first direction and a second direction opposite to the first direction;

a first tray configured to store a first sheet therein;

a second tray configured to store a second sheet therein;

a first rotary member configured to feed the first sheet in a sheet feed direction;

a second rotary member configured to feed the second sheet in the sheet feed direction;

a first transmitting mechanism configured to transmit a rotational force of the motor in a first transmitting direction, wherein the first transmitting mechanism comprises an upstream portion connected to the motor, and a downstream portion connected to the first rotary member;

a second transmitting mechanism configured to transmit the rotational force of the motor in a second transmitting direction, wherein the second transmitting mechanism comprises an upstream portion connected to the motor, and a downstream portion connected to the second rotary member;

a first idling mechanism; and a second idling mechanism, wherein when the motor transitions between rotating in the first direction and rotating in the second direction, the first idling mechanism is configured to allow the upstream portion of the first transmitting mechanism to perform an idle rotation with respect to the downstream portion of the first transmitting mechanism, and the second idling mechanism is configured to allow the upstream portion of the second transmitting mechanism to perform an idle rotation with respect to the downstream portion of the second transmitting mechanism.

2. The sheet feed device according to claim 1, wherein the first transmitting mechanism further comprises a first switching member configured to transmit the rotational force of the motor to the first rotary member when the motor rotates in the first direction and to interrupt transmission of the rotational force of the motor to the first rotary member when the motor rotates in the second direction, and wherein the second transmitting mechanism further comprises a second switching member configured to transmit the rotational force of the motor to the second rotary member when the motor rotates in the second direction and to interrupt transmission of the rotational force of the motor to the second rotary member when the motor rotates in the first direction.

3. The sheet feed device according to claim 2, wherein the first idling mechanism is positioned upstream of the first switching member in the first transmitting direction, and the second idling mechanism is positioned upstream of the second switching member in the second transmitting direction.

4. The sheet feed device according to claim 2, wherein the first transmitting mechanism further comprises:

an arm comprising a first end and a second end opposite the first end, wherein the arm is configured to be pivotable about the first end thereof with respect to the first tray, and the first rotary member is attached to the second end of the arm, and the first switching member is positioned in the arm;

a first gear positioned in the arm at a position upstream of the first rotary member in the first transmitting direction; and and a second gear positioned in the arm at a position upstream of the first rotary member in the first transmitting direction, wherein the first switching member is configured to transmit the rotational force of the motor from the first gear to the second gear when the motor rotates in the first direction and to interrupt transmission of the rotational force of the motor from the first gear to the second gear when the motor rotates in the second direction.

5. The sheet feed device according to claim 4, wherein the first gear comprises a sun gear, and the first switching member comprises a planet gear configured to engage with and to move around the sun gear, wherein the planet gear is configured to selectively engage with and disengage from the second gear according to the rotation direction of the motor.

6. The sheet feed device according to claim 4, wherein the first transmitting mechanism further comprises a particular drive shaft, wherein the first end of the arm is pivotably supported on the particular drive shaft.

7. The sheet feed device according to claim 2, wherein the second transmitting mechanism further comprises:

an arm comprising a first end and a second end opposite the first end, wherein the arm is configured to be pivotable about the first end thereof with respect to the second tray, and the second rotary member is attached to the second end of the arm, and the second switching member is positioned in the arm;

a first gear positioned in the arm at a position upstream of the second rotary member in the second transmitting direction;

a second gear positioned in the arm at a position upstream of the second rotary member in the second transmitting direction, wherein the second switching member is configured to transmit the rotational force of the motor from the first gear to the second gear when the motor rotates in the second direction and to interrupt transmission of the rotational force of the motor from the first gear to the second gear when the motor rotates in the first direction.

8. The sheet feed device according to claim 7, wherein the first gear comprises a sun gear, and the second switching member comprises a planet gear configured to engage with and to move around the sun gear, wherein the planet gear is configured to selectively engage with and disengage from the second gear according to the rotation direction of the motor.

9. The sheet feed device according to claim 7, wherein the second transmitting mechanism further comprises a further drive shaft, wherein the first end of the arm is pivotably supported on the further drive shaft.

10. The sheet feed device according to claim 1, wherein the upstream portion of the first transmitting mechanism performs the idle rotation for a first predetermined idle rotation angle, and the upstream portion of the second transmitting mechanism performs the idle rotation for a second predetermined idle rotation angle.

11. The sheet feed device according to claim 10, wherein the first transmitting mechanism further comprises a particular drive shaft positioned upstream of the first switching member in the first transmitting direction, and the first idling mechanism is positioned in the particular drive shaft.

12. The sheet feed device according to claim 11, wherein the particular drive shaft comprises a first shaft segment and a second shaft segment positioned downstream of the first shaft segment in the first transmitting direction, and the first idling mechanism comprises a first coupling positioned at an end of the first shaft segment and a second coupling positioned at an end of the second shaft segment, and the first coupling is configured to couple with the second coupling such that a clearance is formed therebetween in a rotation direction of the first shaft segment, and wherein the clearance corresponds to the first predetermined idle rotation angle.

13. The sheet feed device according to claim 12, wherein one of the first coupling and the second coupling comprises a key positioned at a corresponding one of the first shaft segment and the second shaft segment, and an other of the first coupling and the second coupling comprises a keyhole formed at a corresponding other one of the first shaft segment and the second shaft segment, wherein the keyhole has the clearance formed therein, and the clearance formed in the keyhole, with respect to the key, corresponds to the first predetermined idle rotation angle.

14. The sheet feed device according to claim 10, wherein the second transmitting mechanism further comprises a further drive shaft positioned upstream of the second switching member in the second transmitting direction, and the second idling mechanism is positioned in the further drive shaft.

15. The sheet feed device according to claim 14, wherein the further drive shaft comprises a first shaft segment and a second shaft segment positioned downstream of the first shaft segment in the second transmitting direction, and the second idling mechanism comprises a first coupling positioned at an end of the first shaft segment and a second coupling positioned at an end of the second shaft segment, and the first coupling is configured to couple with the second coupling such that a clearance is formed therebetween in a rotation direction of the first shaft segment, and wherein the clearance corresponds to the second predetermined idle rotation angle.

16. The sheet feed device according to claim 15, wherein the one of the first coupling and the second coupling comprises a key positioned at a corresponding one of the first shaft segment and the second shaft segment, and an other of the first coupling and the second coupling comprises a keyhole formed at a corresponding other one of the first shaft segment and the second shaft segment, wherein the keyhole has the clearance formed therein, and the clearance formed in the keyhole, with respect to the key, corresponds to the second predetermined idle rotation angle.

17. The sheet feed device according to claim 10, wherein the first transmitting mechanism further comprises a plurality of gears positioned between the first idling mechanism and the first rotary member, and the first predetermined idle rotation angle corresponds to a rotation angle of the plurality of gears that releases surface pressures between the plurality of gears.

18. The sheet feed device according to claim 10, wherein the second transmitting mechanism further comprises a plurality of gears positioned between the second idling mechanism and the second rotary member, and the second predetermined idle rotation angle corresponds to a rotation angle of the plurality of gears that releases surface pressures between the gears.

19. The sheet feed device according to claim 10, further comprising:

a controller configured to control rotation of the motor; and a conveying unit positioned downstream of the first rotary member and the second rotary member in the sheet feed direction and configured to convey one of the first sheet fed from the first tray and the second sheet fed from the second tray to an image recording position;

wherein the controller is configured to rotate the motor in one of the first direction and the second direction such that one of the first rotary member and the second rotary member feeds one of the respective first and second sheets, and is configured to rotate the motor in the other of the first direction and the second direction for a predetermined rotation angle after the conveying unit starts conveying the sheet, wherein when the motor rotates for the predetermined rotation angle, the upstream portion of the first transmitting mechanism performs an idle rotation for up to the first predetermined idle rotation angle, and the upstream portion of the second transmitting mechanism performs an idle rotation for up to the second predetermined idle rotation angle.

20. The sheet feed device according to claim 10, further comprising:

a controller configured to control rotation of the motor; and a detecting unit configured to detect whether one of the first sheet and the second sheet is jammed at a position downstream of at least one of the first rotary member and the second rotary member in the sheet feed direction;

wherein the controller is configured to rotate the motor in one of the first direction and the second direction such that one of the first rotary member and the second rotary member feeds one of the respective first and second sheets, and is configured to rotate the motor in the other of the first direction and the second direction for a predetermined rotation angle, when the detecting unit detects that the sheet is jammed, wherein when the motor rotates for the predetermined rotation angle, the upstream portion of the first transmitting mechanism makes an idle rotation for up to the first predetermined idle rotation angle, and the upstream portion of the second transmitting mechanism performs an idle rotation for up to the second predetermined idle rotation angle.

21. The sheet feed device of claim 1, wherein the upstream portion of the first transmitting mechanism is upstream of the first idling member, and the downstream portion of the first transmitting mechanism is downstream of the first idling member, and wherein the upstream portion of the second transmitting mechanism is upstream of the second idling member, and the downstream portion of the second transmitting mechanism is downstream of the second idling member.

22. The sheet feed device according to claim 1, wherein the upstream portion of the first transmitting mechanism is connected to the motor at a first end of the first transmitting mechanism, and the downstream portion of the first transmitting mechanism is connected to the first rotary member at a second end of the first transmitting mechanism opposite the first end, and wherein the upstream portion of the second transmitting mechanism is connected to the motor at a first end of the second transmitting mechanism, and the downstream portion of the second transmitting mechanism is connected to the second rotary member at a second end of the second transmitting mechanism opposite the first end.

23. A sheet feed device comprising:

a motor configured to selectively rotate in a first direction and a second direction opposite to the first direction;

a first tray configured to store a first sheet therein;

a second tray configured to store a second sheet therein;

a first rotary member configured to contact the sheet in the first tray and to feed the sheet in a sheet feed direction;

a second rotary member configured to contact the sheet in the second tray and to feed the sheet in the sheet feed direction;

a first transmitting mechanism comprising a first end connected to the motor and a second end opposite the first end connected to the first rotary member, the first transmitting mechanism comprising a first switching member configured to transmit a rotational force of the motor to the first rotary member when the motor rotates in the first direction and to interrupt transmission of the rotational force of the motor to the first rotary member when the motor rotates in the second direction; and a second transmitting mechanism comprising a first end connected to the motor and a second end opposite the first end connected to the second rotary member, the first transmitting mechanism comprising a second switching member configured to transmit the rotational force of the motor to the second rotary member when the motor rotates in the second direction and to interrupt transmission of the rotational force of the motor to the second rotary member when the motor rotates in the first direction.

24. An image recording apparatus comprising:

a sheet feed device comprising:

a motor configured to selectively rotate in a first direction and a second direction opposite to the first direction;

a first tray configured to store a first sheet therein;

a second tray configured to store a second sheet therein;

a first rotary member configured to feed the first sheet in a sheet feed direction;

a second rotary member configured to feed the second sheet in the sheet feed direction;

a first transmitting mechanism configured to transmit a rotational force of the motor in a first transmitting direction, wherein the first transmitting mechanism comprises an upstream portion connected to the motor, and a downstream portion connected to the first rotary member;

a second transmitting mechanism configured to transmit the rotational force of the motor in a second transmitting direction, wherein the second transmitting mechanism comprises an upstream portion connected to the motor, and a downstream portion connected to the second rotary member;

a first idling mechanism; and a second idling mechanism, wherein when the motor transitions between rotating in the first direction and rotating in the second direction, the first idling mechanism is configured to allow the upstream portion of the first transmitting mechanism to perform an idle rotation with respect to the downstream portion of the first transmitting mechanism, and the second idling mechanism is configured to allow the upstream portion of the second transmitting mechanism to perform an idle rotation with respect to the downstream portion of the second transmitting mechanism; and a recording unit configured to record an image on one of the first sheet and the second sheet fed by the sheet feed device.

* * * * *